US006553633B1

(12) United States Patent
Rantala

(10) Patent No.: US 6,553,633 B1
(45) Date of Patent: Apr. 29, 2003

(54) WRISTBAND CONNECTION IN A DEVICE

(75) Inventor: Helena Rantala, Oulu (FI)

(73) Assignee: Polar Electro Oy, Kempele (FI)

( * ) Notice: Subject to any disclaimer, the term of this patent is extended or adjusted under 35 U.S.C. 154(b) by 0 days.

(21) Appl. No.: 09/577,793

(22) Filed: May 24, 2000

(30) Foreign Application Priority Data

May 31, 1999 (FI) ..... U990250

(51) Int. Cl.[7] ..... A44B 11/24; A44C 5/00
(52) U.S. Cl. ..... 24/265 WS; 24/178; 24/320
(58) Field of Search ..... 24/265 WS, 265 EC, 24/265 BC, 163 R, 317, 316, 322, 320, 187, 178, 169, 174, 176, 185, 186; 2/322; 63/3; 224/164

(56) References Cited

U.S. PATENT DOCUMENTS 1,073,115 A * 9/1913 Haller ..... 24/320 X
1,134,686 A * 4/1915 Line ..... 24/163 R
1,828,196 A * 10/1931 McCann ..... 2/322
3,036,352 A * 5/1962 Kehrer ..... 24/178

* cited by examiner

*Primary Examiner*—Robert J. Sandy
(74) *Attorney, Agent, or Firm*—Hoffmann & Baron, LLP

(57) ABSTRACT

A wristband connection for a heart rate monitor specifically, a pin-hole connection. The wristband has a first section with at least one hole and the first section is attachable to the device, and a second section of the wristband attachable to the device. The second section has a locking device with a pin. A front wall and a back wall of the hole that are against the pin and transversely to the longitudinal axis in the longitudinal direction of the first section are inclined between an upper surface and a lower surface of the first section from the perpendicular direction between the upper surface and the lower surface towards the end of the first section attached to the device.

15 Claims, 3 Drawing Sheets

WRISTBAND CONNECTION IN A DEVICE

FIELD OF THE INVENTION

The invention relates to a wristband connection, e.g. a wristband connection in a heart rate monitor. A heart rate monitor is a device used in sports and medicine, the device measuring the pulse of a human heart by means of an electrode belt on the chest or by means of a device based on pressure measurement at the wrist.

BACKGROUND OF THE INVENTION

Wristbands generally use a buckle fastening as a connection. A wristband comprises two sections. The wristband sections are attached on the opposite sides of a heart rate monitor either fixedly or detachably by means of a specific pin, which makes the sections turn and bend around the user's wrist, following the form of the wrist. The wristband can also be made of a uniform part, i.e. the wristband does not consist of two separate sections, and the term "section" refers to two zones that are in the uniform part.

There is a connection in the wristband of the heart rate monitor, and when the connection is locked, a pin of the locking device is in the hole. The connection used in heart rate monitors is illustrated in FIG. 2A. The pin 110 of the locking device is inserted into the hole 106 piercing the wristband 102. As it can be seen from FIG. 2A, the hole 106 piercing the wristband 102 is perpendicular. The problem is that the pressure caused by the pin 110 is not evenly directed onto the walls of the hole 106, and thus the walls of the hole 106 wear in use.

Another way of making a connection in wrist watches is shown in FIG. 2B. A perpendicular hole 106 is first made through a wristband 102, whereafter the hole 106 is enlarged at the front and at the back of the wristband 102, whereby cones 200, 202 are formed at both ends of the straight section 206 of the hole 106. This solution does not direct the pressure of the pin 110 very widely to the walls of the hole 106 either, and the walls of the hole 106 wear in use. In addition, when the pin is inserted to the hole, the free end that is passed through the frame of the wristband rises, and thus it does not follow the form of the wrist. Likewise, the frame tends to rise in respect of the wrist. This is why the watch and the wristband do not follow the form of the wrist very well, and they can get caught in clothes or other objects and they may fall off as well. As regards the design of such a wristband, it looks unaesthetic at the user's wrist.

This problem is avoided by the known solutions described above. The holes can also be made bigger, whereby it is easier for the pin to follow the form of the wrist. This causes problems in the design of the wristband, as a bigger hole is needed, and on the other hand, the bigger hole causes a loose fastening and thus the risk of the falling of the wristband. One solution is to employ a profiled pin, whereby the shape of the fastening pin fits better to the hole perpendicular to the wristband surface. Another solution is to use a band for binding the free end of the wristband to follow the form of the wrist.

BRIEF DESCRIPTION OF THE INVENTION

The object of the invention is thus to provide a connection for solving the above problems. This is achieved by a connection, which is described in the following. It is a wristband connection comprising: a first section of the wristband attachable to the device, which first section is provided with at least one hole; a second section of the wristband attachable to the device, the second section comprising a locking device with a pin; the connection is openably closable such that the pin is inserted into the hole; a front wall and a back wall of the hole that are against the pin and transversely to the longitudinal axis in the longitudinal direction of the first section are inclined between an upper surface and a lower surface of the first section from the perpendicular direction between the upper surface and the lower surface towards the end of the first section, which is attachable to the device.

The invention also relates to a wristband connection, comprising: a first section of the wristband attachable to the device, which first section is provided with a hole; a second section of the wristband attachable to the device, the second section comprising a locking device with a pin; the connection is openably closable such that the pin is inserted into the hole; an axle between the centre point of the hole on the upper surface of the first section and the centre point of the hole on the lower surface of the first section is inclined from the perpendicular direction between the upper surface and the lower surface towards the end of the first section, which is attachable to the device.

The preferred embodiments of the invention are claimed in the dependent claims.

The invention is based on the idea that the hole is not made perpendicularly through the wristband, but the longitudinal axis of the hole is inclined.

The method and system of the invention provide many advantages. The pin rests better in the hole, i.e. the pressure caused by the pin is directed to a wider area in the walls of the hole than before, and the walls of the hole withstand the wearing better. In addition, the wristband follows the form of the wrist better.

BRIEF DESCRIPTION OF THE DRAWINGS

In the following the invention will be described in greater detail in connection with the preferred embodiments, with reference to the attached drawings, in which.

DETAILED DESCRIPTION OF THE INVENTION

Figure 1A:
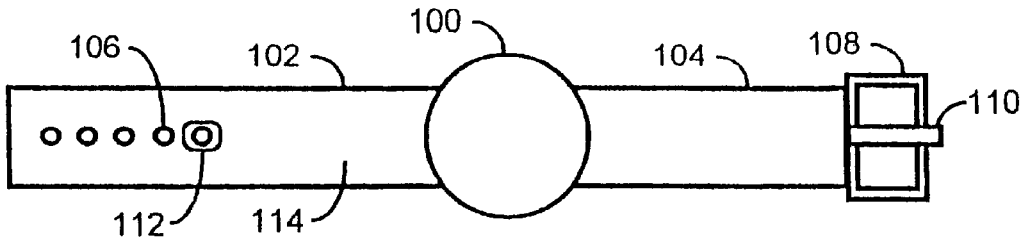
FIGS. 1A and 1B illustrate a top and a side view of a structure of a heart rate monitor.
Figure 1B:
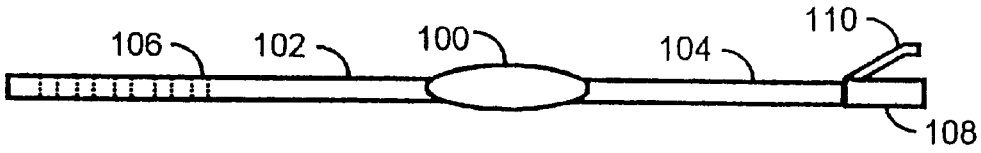

FIGS. 1A and 1B show a top and a side view of a structure of a heart rate monitor. A first section 102 of a wristband, provided with at least one hole 106, is attached to the heart rate monitor. In our example, there are five holes 106. A second section 104 of the wristband is attached to the opposite end of the heart rate monitor 100. There is a locking device in the second section 104, which locking device is at its simplest only a hinged pin 110 attached to the second section 104.

The openable connection which fastens the wristband is formed such that the pin 110 is inserted into the hole 106.

Figure 3C:
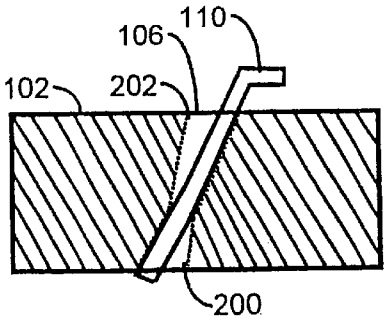
FIGS. 3A, 3B, 3C illustrate ways of the invention of implementing a wristband connection.
Figure 3B:
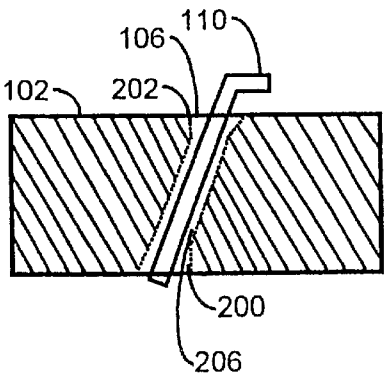
Figure 3A:
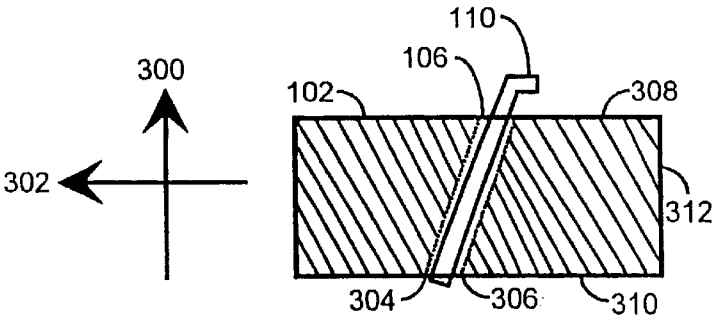

FIG. 3A illustrates how the connection is implemented according to the invention. A front wall 304 and a back wall 306 of the hole that are against the pin 110 and transversely to the longitudinal axis 302 in the longitudinal direction of the first section 102 are inclined between an upper surface 308 and a lower surface 310 of the first section 102 from the perpendicular direction 300 between the upper surface 308 and the lower surface 310 towards the end 312 of the first section 102, which is attached to the heart rate monitor 100. In the described solution the left bottom side of the pin 110 rests against the front wall 304 of the hole at so long a distance as possible, especially as the tension is directed to the connection.

In a preferred embodiment, an axle between the centre point of the hole 106 on the upper surface 308 of the first section 102 and the centre point of the hole 106 on the lower surface 310 of the first section 102 is inclined from the perpendicular direction 300 between the upper surface 308 and the lower surface 310 towards the end 312 of the first section 102, which is attached to the device 100. Thus, the part of the hole 106 piercing the upper surface 308 of the first section 102 is, when observed along the longitudinal axis in the longitudinal direction of the first section 102, closer to the device 100 than the part of the hole 106 piercing the lower surface 310 of the first section 102. The inclination from the perpendicular direction varies between 5 and 60 degrees, for example, preferably being 30 to 45 degrees.

In a preferred embodiment, the locking device comprises a frame 108, and when the connection is closed, the first section 102 is taken through the frame 108 and part of the pin 110 rests against the frame 108. This is the typical locking device used in watch wristbands. The holes 106 are typically in line in the middle of the first section 102, and a hole 106 is chosen among them, which is the most suitable for achieving a desired tightness around the wrist.

Figure 2A:
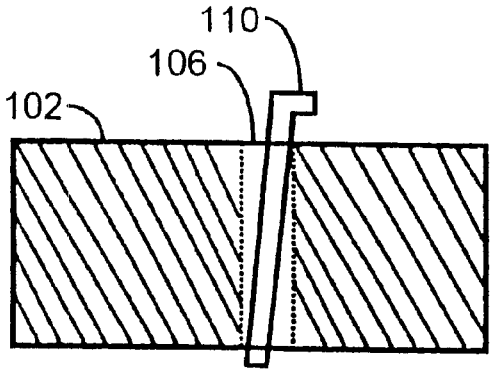
Prior Art Fig 2A
FIGS. 2A and 2B illustrate the known ways of implementing the connection described above.
Figure 2B:
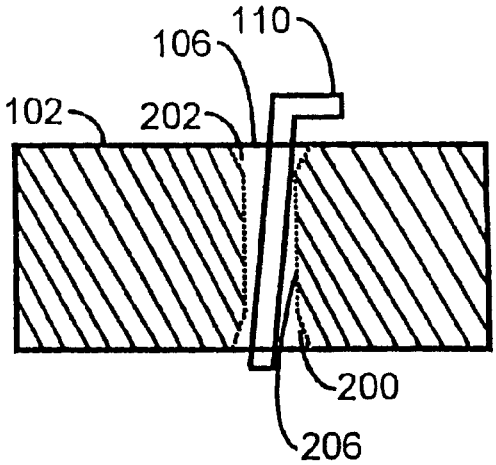
Prior Art Fig 2B

FIG. 3B illustrates a corresponding solution as the prior art solution in FIG. 2B, but implemented in accordance with the invention. As it can be seen from FIG. 3B, the hole 106 is inclined. The hole is formed of the truncated cones 200, 202 in such a manner that the cones are narrowing towards the interior of the first section 102. In the prior art solution, the hole 106 forms an hourglass in a way, whereas in the solution of the invention the vertical axis of this hourglass is inclined.

FIG. 3C describes a solution, in which the straight section 206 between the cones 200, 202 has been left out. Likewise, the cones 200, 202 are not of equal length, but lower cone 200 is shorter than the upper cone 202. As the basic solution of the invention to incline the hole 106 has been described for a person skilled in the art, these various modifications are clear to him and they are the solutions according to the invention. It is also clear to a person skilled in the art, as it can be seen from FIG. 3C, that the pin 110 is formed such that it preferably follows the form of the front edge 202 and the back edge 200 of the hole 106.

In a preferred embodiment, a collar 112 edging the hole 106 in the first section 102 of the wristband of FIG. 1 is made of a first material, and the rest of the first section 102 of the wristband is mold from a second material. This can be done for example if areas of different colors are required for the wristband, or if a more durable material is required for the collar 112 than for the rest 114 of the section.

Although the invention has been described above with reference to the example according to the attached drawings, it is obvious that the invention is not restricted thereto, but may be modified in a variety of ways within the scope of the inventive idea disclosed in the claims.

What is claimed is:

1. A wristband connection comprising:

a first section of the wristband attachable to a device, which first section is provided with at least one hole;

a second section of the wristband attachable to the device, the second section comprising a locking device with a pin;

the connection is openably closable such that the pin is inserted into the hole;

a front wall and a back wall of the hole that are against the pin and transversely to the longitudinal axis in the longitudinal direction of the first section are inclined between an upper surface and a lower surface of the first section from the perpendicular direction between the upper surface and the lower surface towards an end of the first section, which is attachable to the device.

2. A connection as claimed in claim 1, wherein the locking device comprises a frame, and when the connection is closed, the first section is taken through the frame and part of the pin rests against the frame.

3. A connection as claimed in claim 1, wherein the hole is formed of the truncated cones opposite to each other in such a manner that the cones are narrowing towards the interior of the first section.

4. A connection as claimed in claim 1, wherein a collar edging the hole is made of a first material, and the rest of the first section of the wristband is molded from a second material.

5. A connection as claimed in claim 1, wherein the device is a heart rate monitor.

6. A wristband connection comprising:

a first section of the wristband attachable to a device, which first section is provided with at least one hole;

a second section of the wristband attachable to the device, the second section comprising a locking device with a pin;

the connection is openably closable such that the pin is inserted into the hole;

an axis between the centre point of the hole on the upper surface of the first section and the centre point of the hole on the lower surface of the first section which is inclined from the perpendicular direction between the upper surface and the lower surface towards the end of the first section, which is attachable to the device.

7. A connection as claimed in claim 6, wherein the locking device comprises a frame, and when the connection is closed, the first section is taken through the frame and part of the pin rests against the frame.

8. A connection as claimed in claim 6, wherein the hole is formed of the truncated cones opposite to each other in such a manner that the cones are narrowing towards the interior of the first section.

9. A connection as claimed in claim 6, wherein a collar edging the hole is made of a first material, and the rest of the first section of the wristband is molded from a second material.

10. A connection as claimed in claim 6, wherein the device is a heart rate monitor.

11. A wristband connection comprising:

a first section of the wristband attachable to a device, which first section is provided with at least one hole;

a second section of the wristband attachable to the device, the second section comprising a locking device having a frame and a pin, wherein when the connection is closed, the first section is taken through said frame and a part of said pin rests against said frame and the pin is inserted into the hole; and a front wall and a back wall bordering the hole and extending transversely to the longitudinal axis in the longitudinal direction of the first section, the front and back walls being inclined between an upper surface and a lower surface of the first section from the perpendicular direction between the upper surface and the lower surface towards an end of the first section which is attachable to the device.

12. A wristband connection comprising:

a first section of the wristband attachable to a device, which first section is provided with at least one hole;

a second section of the wristband attachable to the device, the second section comprising a locking device having a frame and a pin, wherein when the connection is closed, the first section is taken through said frame and part of said pin rests against said frame;

the connection is openable and closable and the pin is insertable into the hole; and an axis between the centre point of the hole on the upper surface of the first section and the centre point of the hole on the lower surface of the first section which is inclined from the perpendicular direction between the upper surface and the lower surface towards the end of the first section which is attachable to the device.

13. A connection as claimed in claim 12, wherein said pin follows the front wall and back wall of the hole.

14. A connection as claimed in claim 1, wherein said hole is formed of a first truncated cone and an oppositely positioned second truncated cone and said first truncated cone is longer in length than the second truncated cone and said first truncated cone and said second truncated cone both narrow towards the interior of the first section.

15. A connection as claimed in claim 14, wherein said pin follows the front wall and back wall of the hole which is formed of said first truncated cone and said second truncated cone.

* * * * *